US005984457A

United States Patent [19]

Taub et al.

[11] Patent Number: 5,984,457

[45] Date of Patent: Nov. 16, 1999

[54] SPRAY-MODE INKJET PRINTER

[75] Inventors: Howard H. Taub, San Jose; John D. Meyer, Tracy, both of Calif.

[73] Assignee: Hewlett-Packard Company, Palo Alto, Calif.

[21] Appl. No.: 08/948,094

[22] Filed: Oct. 9, 1997

Related U.S. Application Data

[63] Continuation of application No. 08/401,064, Mar. 8, 1995, abandoned.

[51] Int. Cl.[6] ..... B41J 2/05

[52] U.S. Cl. ..... 347/56

[58] Field of Search ..... 347/15, 54, 55, 347/56, 57, 61, 62, 73, 53

[56] References Cited

U.S. PATENT DOCUMENTS

| | | | |
|---|---|---|---|
| 3,287,734 | 11/1966 | Kazan | 347/53 |
| 3,416,153 | 12/1968 | Hertz et al. | 347/73 |
| 3,717,875 | 2/1973 | Arciprete et al. | 347/73 |
| 4,308,547 | 12/1981 | Lovelady et al. | 347/46 |
| 4,686,539 | 8/1987 | Schimdle et al. | 347/15 |
| 4,965,610 | 10/1990 | Ishikawa | 347/61 |
| 5,563,642 | 10/1996 | Keefe et al. | 347/84 |

OTHER PUBLICATIONS

W. A. Buskirk, D.E. Hackleman, S.T. Hall, P.H. Kanarek, R.N. Low, K.E. Trueba and R.R. Van de Poll, "Development of a High–Resolution Thermal Inkjet Printhead", Hewlett Packard Journal, Oct. 1988, pp. 55–61.

*Primary Examiner*—N. Le
*Assistant Examiner*—L. Anderson

[57] ABSTRACT

A thermal inkjet printer is operated in a spray-mode by deliberately firing ink droplets from a printhead while the meniscus of the remaining ink in the printhead is settling down. Generally, the drops will not travel in a direction perpendicular to the printing surface. By calibrating the printhead, one can determine how many drops are needed to be fired within the boundaries of a pixel to achieve any given optical density. Drops may be fired at rates above 50 kHz, and, depending on the ink, above 70 kHz. Ink with a viscosity of 10 centi-Poise or less, and even 2 centi-Poise or less, may be used. When one is printing both text and non-text images on the same surface, a digital representation of an image to be printed is analyzed and divided into non-text image fields and text fields. Each non-text image field is printed on the printing surface by projecting the corresponding ink droplets in the spray-mode. Each text field is printed on the printing surface in a text-mode, in which the firing rate is typically reduced to 5–10 kHz and the corresponding ink droplets are projected substantially perpendicular to the printing surface.

20 Claims, 3 Drawing Sheets

SPRAY-MODE INKJET PRINTER

CROSS REFERENCE TO RELATED APPLICATION

This is a continuation of application Ser. No. 08/401,064 filed on Mar. 8, 1995, now abandoned.

BACKGROUND OF THE INVENTION

This invention relates generally to inkjet printers and particularly to inkjet printers that can print in a spray-mode.

Two ever-present and normally conflicting goals of inkjet printing is that what is printed should be as life-like or sharp as possible and also that the printing process should be as fast as possible. One way to increase both the sharpness of text and the lifelikeness of non-text images is to increase the print resolution, that is, the number of ink drops that are applied per unit printing area and are accurately placed with separation within that area. The unit printing area is typically the so-called "pixel," which is the common abbreviation for "picture element."

The conventional way of controlling the number of ink dots per pixel is to improve the repeatable accuracy in the "aim" of every printhead in the inkjet printer. One problem with this is that every time an ink drop is fired from the printhead, it takes time for the meniscus of the printing fluid (the "ink") in the printhead to settle down and level out enough to fire the next drop accurately. In such conventional printheads, it is also important for the meniscus to return to a stable initial condition so that the drops that are fired will be of approximately the same size.

In order to damp out and avoid resonant modes on the meniscus and thereby to try to ensure that the ink drops are ejected straight and placed accurately within a pixel, conventional printheads lower the firing velocity and the firing rate based substantially on the viscosity of the ink. Normal firing velocities are on the order of ten meters per second (m/s); and common firing rates are less than 10 kHz.

U.S. Pat. No. 4,503,445 (Tacklind, Mar. 5, 1985) describes a thermal inkjet printer that emits discrete drops whose volume varies to create a printed gray scale. In the Tacklind inkjet printer, ink droplets are fired in groups, so that each subsequent droplet in a group is fired before the previous one separates from the meniscus of the ink in the printhead. The individual droplets within each group then merge on the surface of the medium to be printed because all the droplets are designed to travel along the same direction to go to the same area. Darker pixels can be created by increasing the number of droplets fired into them.

Although the Tacklind system makes it possible to use a heating element for firing the drops that are physically undersized for the particular ink being used, it still relies on an ability to fire droplets straight, that is, in a direction normal to an ejection plane of the printhead, which is typically also normal to the pixel. The maximum single-droplet emission rate for the ink used in the basic embodiment of the Tacklind system is roughly 10 kHz. This typical rate is much lower than the firing rate that one could achieve by the printhead.

In order to increase printing speed even further, what is needed is a way to operate an inkjet printer at a rate much higher than is required for the meniscus of the ink to settle down, which is substantially the maximum possible rates of conventional systems such as Tacklind's.

SUMMARY OF THE INVENTION

The thermal inkjet printer of the present invention can operate in a spray-mode. In this spray-mode operation, the inkjet printer does not require the meniscus of the ink to settle down before ejecting another droplet. Thus, the inkjet printer can operate at a rate much higher than conventional inkjet printers. Another benefit of the present invention is that although the present invention can operate at a much higher rate than conventional inkjet printers, the present invention can use substantially the same hardware in the conventional printers.

The printhead of a thermal inkjet printer has a heating element, ink and an opening through which the ink is ejected from the printhead towards a printing surface. The heating element, typically a resistor, is energized by electrical power pulses. Each pulse superheats the ink in the immediate vicinity of the resistor. The superheated ink vaporizes and generates a short-lived (less than about 1 micro second) pressure pulse, which is substantially in excess of one atmosphere. This pressure pulse delivers momentum to the ink, pushing the ink away from the resistor so that a void or bubble is created in the ink. The pressure in this void quickly (in about 2 microseconds) drops to the saturation pressure of the fluid. With ambient temperature much lower than the boiling point of the fluid, this saturation pressure is much less than one atmosphere. The external atmospheric pressure eventually causes the bubble to collapse and it is the collapse process which causes the droplet to separate from the bulk of the fluid and proceed away from the opening of the printhead.

In the spray-mode operation according to the invention, the heating element is sequentially energized at a firing rate by applying to the heating element a series of pulses of power, such as current pulses. Each pulse causes a void in the ink and projects a droplet from the printhead toward the printing surface. Several droplets are typically fired into a single pixel of the printing surface; the number of droplets needed to achieve any given degree of grayness in the pixel is determined by conventional pre-calibration techniques.

In the spray-mode, at least one of the droplets is deliberately projected onto the printing surface in a direction that is not perpendicular to the printing surface. The firing rate can be at or greater than 50 kHz, and may even be as high as 70 kHz or higher. The firing rate will depend in part on the viscosity of the chosen ink. The invention makes possible the use of ink with a viscosity of 10 centi-Poised or less, and even 2 centi-Poise or less.

The invented inkjet printer can also operate in a dual-mode. In this operation, a digital representation of an image to be printed is divided into non-text image fields and text fields. Each non-text image field is printed on the printing surface by projecting the corresponding ink droplets in the spray-mode. Each text field is printed on the printing surface in a text-mode, in which the firing rate is typically reduced to 5–10 kHz and the corresponding ink droplets are projected onto the printing surface in a direction that is substantially perpendicular to the printing surface.

Other aspects and advantages of the present invention will become apparent from the following detailed description, which, when taken in conjunction with the accompanying drawings, illustrates by way of example the principles of the invention.

BRIEF DESCRIPTION OF THE DRAWINGS

FIGS. 1A–1F, and 4A–4F, are cross-sections through the respective printheads taken along a plane that is perpendicular to the printing surface and to a plane defined by an ejection opening of the printhead.

Same numerals in FIGS. 1–6 are assigned to similar elements in all the figures. Embodiments of the invention are discussed below with reference to FIGS. 1–6. However, those skilled in the art will readily appreciate that the detailed description given herein with respect to these figures is for explanatory purposes as the invention extends beyond these limited embodiments.

DETAILED DESCRIPTION

Figure 1A:
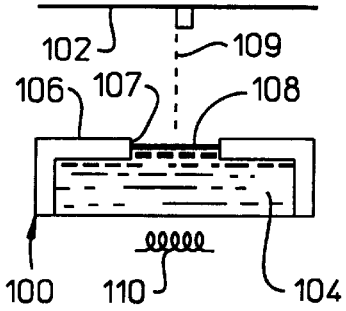
(PRIOR ART) FIG. 1A
Figures 1A–1F illustrate the firing of a single droplet onto a printing surface using a conventional thermal inkjet printhead.

FIG. 1A illustrates the general structure of a conventional thermal inkjet printhead. The printhead 100 fires ink droplets into pixels on a printing surface 102. Printing fluid such as ink 104 is contained within a housing 106, which will typically consist of a portion of a multi-layered construction. The housing 106 thus holds a reservoir of the ink 104. A printhead 100 has an opening 107, through which drops are ejected roughly straight towards the printing surface 102. In a stable or initial state, the ink 104 will have a meniscus 108 that forms across the opening 107. In conventional printheads, the desired trajectory for the ink drops is along a line 109, which extends from a center point of the opening 107 perpendicular to the meniscus 108 when it is at rest, and also preferably perpendicular to the printing surface 102.

For thermal inkjet printers, a heating element 110, which is typically a resistor, is mounted opposite the opening 107 and is controlled and driven by conventional circuitry. Conventional heating elements are commonly energized using current pulses with an amplitude on the order of one Ampere and a duration on the order of a few microseconds. Typical heating elements can superheat the ink in the immediate vicinity of the elements to a temperature much higher than the ink's boiling temperature, with a maximum cycle time on the order of 80 kHz. As is discussed both above and below, however, conventional printheads are not able to utilize the full 80 kHz potential of the heating elements; furthermore, they would be even more poorly suited to use even higher speed heating elements that may become available in the future.

Figure 1B:
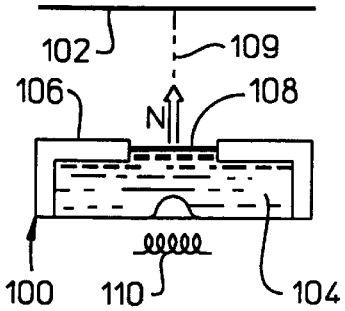
(PRIOR ART) FIG. 1B

FIG. 1B illustrates what happens when the heating element 110 is energized by a pulse. The ink immediately adjacent to the heating element 110 is super-heated above its boiling temperature to create a pressure pulse so that a small void or "bubble" 112 forms within the printhead cavity. In this state, the direction that is perpendicular or normal to the meniscus 108 is also approximately perpendicular to the printing surface 102. This normal direction is indicated by the arrow N, and by the desired line of trajectory 109.

Figure 1C:
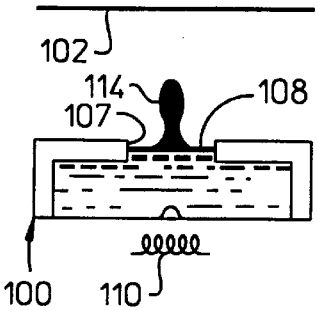
(PRIOR ART) FIG. 1C
Figure 1D:
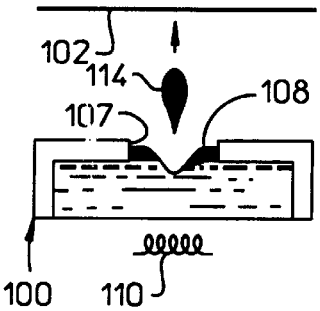
(PRIOR ART) FIG. 1D

In FIG. 1C, the power to the heating element 110 has been turned off after the pulse. The atmospheric pressure forces the bubble 112 to collapse ejecting a drop 114 of ink through the opening 107. In FIG. 1D, the drop 114 has separated from the remaining fluid and travels towards the printing surface 102 substantially in the normal direction N indicated in FIG. 1B.

Immediately upon separation of the drop 114, an empty space is left within the region of the printing fluid, so that a cross-section through the printhead would show the meniscus 108 extending from either side of the opening 107 and forming a generally concave, curved surface.

Figure 1E:
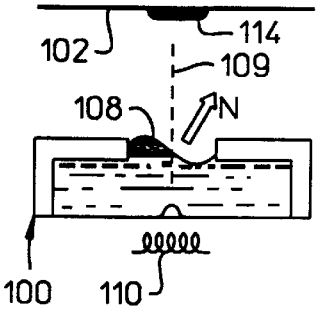
(PRIOR ART) FIG. 1E

FIG. 1E shows the previously separated drop 114 having adhered to the printing surface 102. This figure also illustrates that, in returning to its stable, substantially planar state, the meniscus 108 will exhibit a number of resonance modes, that is, it will be uneven with uneven curvature until it has settled down to the minimum-energy shape shown in FIG. 1A. During the settling time, however, there is no constant normal direction for the meniscus 108. For example, the normal direction for the approximate center of the meniscus shown in FIG. 1E is indicated by the arrow N, but a drop fired in this direction would not be coincident with the previously fired drop 114.

Figure 1F:
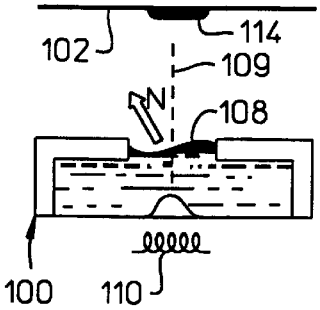
(PRIOR ART) FIG. 1F
Figure 2A:
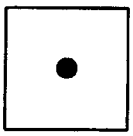
(PRIOR ART) FIG. 2A
FIGS. 2A–2D illustrate the manner in which conventional inkjet printers create pixels with different optical densities by increasing the number of well-placed, uniform ink drops within each pixel.
Figure 2B:
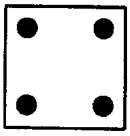
(PRIOR ART) FIG. 2B
Figure 2C:
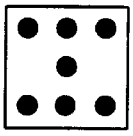
(PRIOR ART) FIG. 2C
Figure 2D:
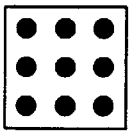
(PRIOR ART) FIG. 2D

In FIG. 1F, the meniscus has settled down somewhat compared with FIG. 1E, but it is still not in its resting state, so that the normal direction N is still not perpendicular to the printing surface 102. In order to ensure accuracy and repeatability, therefore, known printheads must wait for the meniscus 108 to settle down to being approximately planar before the next drop is fired. Although, as FIGS. 1E and 1F show, the heating element may be energized to form a new bubble before the meniscus settles down completely, the conventional printhead can still not operate with the firing rate as high as the cycle time for the heating element 110. In great part, this is because of the need of conventional systems to allow the meniscus 108 to settle.

FIGS. 2A–D illustrate the way in which conventional thermal inkjet printheads create pixels with increasing optical density. As the figures indicate, darker pixels are created simply by accurately placing a larger number of ink dots within the area of the pixel. One can see that accurate placement of the fired ink droplets is essential for ensuring the proper optical density for the pixel. As is pointed out above, however, this means that one must wait until the meniscus settles down before firing another drop. Another shortcoming of such systems is that an entire pixel can normally not be generated with a single pass of the printhead: rather, the printhead may require to make multiple passes over the pixels in order to give each its proper optical density.

FIG. 3 illustrates the way in which the multidrop Tacklind printhead creates pixels with different optical densities. In FIG. 1C, the droplet 114 has not yet separated from the meniscus 108. In the Tacklind system, a second droplet is generated by energizing and de-energizing the heating element 110 before the first droplet has completely separated. A third droplet may also be generated before the second separates, and so on. With the droplets all travelling along the same direction towards the same area, the droplets collapse to a single dot when they reach the medium to be printed. A two-droplet drop will thereby cover more of the surface of the pixel than will a one-droplet drop.

Figure 3A:
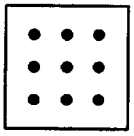
(PRIOR ART) FIG. 3A
FIGS. 3A–3D illustrate the manner in which multidrop inkjet printers such as Tacklind's create pixels with different optical densities.
Figure 3B:
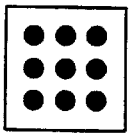
(PRIOR ART) FIG. 3B
Figure 3C:
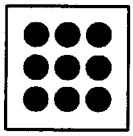
(PRIOR ART) FIG. 3C
Figure 3D:
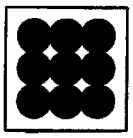
(PRIOR ART) FIG. 3D

The Tacklind system changes the optical density of a pixel by increasing the number of droplets applied at the various points within the pixel. This is illustrated in FIGS. 3A–3D, in which each printed portion of the pixel in FIG. 3B has more droplets per dot than does the pixel shown in FIG. 3A, but fewer droplets per dot than in the pixel illustrated in FIG. 3C. In FIG. 3D, there are so many droplets per dot that they almost cover the entire pixel, that is, they provide almost the maximum optical density. When it comes to black-and-white printing, maximum optical density corresponds to the most black portion of the gray scale, whereas minimum optical density would correspond to no ink at all, that is, the most white portion of the gray scale. As before, however, the Tacklind printer still relies on accurate placement within the pixel of each drop applied to the printing surface.

Most attempts to increase the printing speed of known inkjet printers involve improvements in the mechanical structure of the printer or the mechanical and chemical properties of the ink. Mechanical changes include those such as a smaller opening in the printhead (the meniscus can then settle faster and it becomes easier to fire droplets faster but still perpendicular to the printing surface), and faster printhead carriages. Improvements in inks are intended to produce inks with faster settling times or different heat absorption properties. All of these attempts are designed to increase the speed at which drops can be fired perpendicular to the printing surface. This invention goes against this conventional trend and achieves much higher firing rates using existing structures and inks, as FIGS. 4A–4F and 5A–5D illustrate.

Figure 4A:
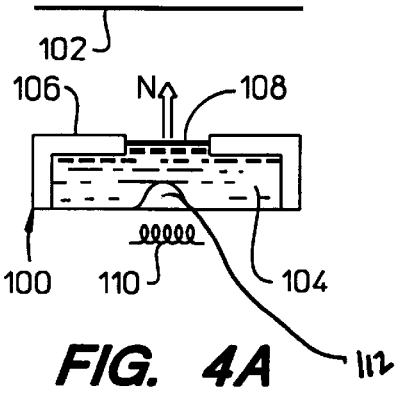
FIGS. 4A–4F illustrate the manner in which the inkjet printer according to the invention fires ink drops onto the printing surface.
Figure 4B:
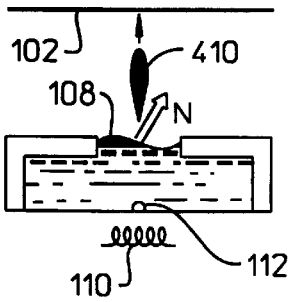

FIGS. 4A–4F illustrate the "spraying" method according to the invention for high-speed inkjet printing. FIG. 4A shows the printhead according to the invention when the meniscus 108 is level and a bubble 112 has been formed by pulsing the heating element 110. The printing fluid that can be used according to the invention typically has a lower viscosity than that used in conventional inkjet printers, but the situation illustrated in FIG. 4A is generally the same as is illustrated in FIG. 1B. As FIG. 4B illustrates, a first drop 410 has been ejected from the printhead; the drop travels towards the printing surface 102 in the normal direction indicated by the arrow N in FIG. 4A.

If one were to fire a drop before the meniscus 108 settles down, the drop would in almost all cases not follow the same path as the previous drop 410. Rather, it would travel in a direction normal to the meniscus, but since the meniscus itself is not at this point planar, the "normal" direction itself will be changing. The second drop will therefore travel at a different normal direction, which is indicated by the arrow N in FIG. 4B. In other words, rather than firing drops in a constant normal direction, the printhead according to the invention "sprays" drops onto the printing surface; although each drop will be ejected in a direction normal to some point of the meniscus, in general the drops will not travel in a direction that is normal to the printing surface itself.

Figure 4C:
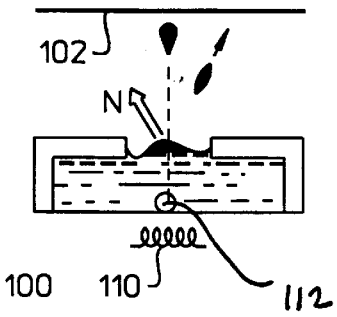
Figure 4D:
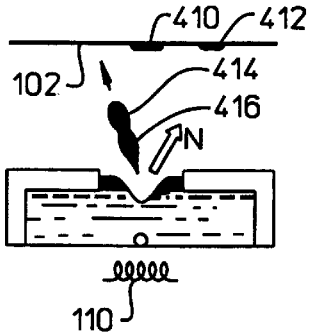

In FIG. 4C, the new drop 412 is proceeding approximately in the direction N indicated in FIG. 4B. The next time the bubble 112 collapses, yet another drop will be ejected in a different direction, which is normal to some point on the meniscus at the instant of ejection. This new direction is indicated as the new direction N shown in FIG. 4C. In FIG. 4D, this new drop 414 is proceeding in the direction shown in FIG. 4C. Because of the high pulse rate of the heating element 110 according to the invention, however, in the situation shown in FIG. 4D, a second firing cycle may have taken place before the drop 414 completely separates from the meniscus 108. Another droplet 416 may, as in the Tacklind System, combine on the medium as a single dot.

Figure 4E:
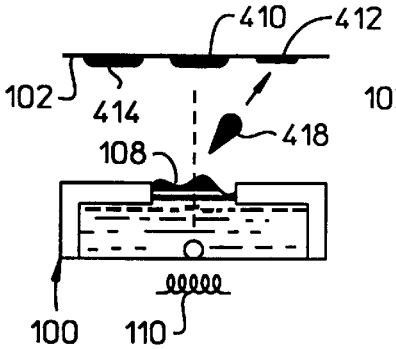
Figure 4F:
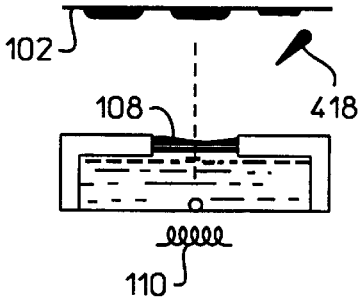

In FIGS. 4E and 4F, an additional drop 418 is fired; the drop proceeds towards the printing surface 102 in a direction that is normal to the meniscus shown in FIG. 4D.

FIGS. 4A–4F illustrate several features of the invention. First, it is not necessary according to the invention to wait until the meniscus has settled before firing the next drop. This allows the use of inks with viscosity 10 centi-Poise or less, or even 2 centi-Poise or less. Prototypes of the invention have operated successfully with an ink viscosity in the range of 1 to 2 centi-Poise. The invention may be used for either black-and-white or color printing, or both: the viscosity of the ink is one of the main factors in determining the maximum firing rate (and thus printing speed) for the invention. No special paper is required for using these inks.

Yet another advantage of the relatively low-viscosity inks that the invention can use is that they allow for superimposition of printed images. Note, however, that the invention eliminates the need for multiple passes of the printhead in order to print a pixel since drops "sprayed" from the printhead will typically be distributed roughly randomly over the entire surface of the pixel to create any given, pre-calibrated optical density.

Second, as FIG. 4C illustrates, it is not necessary according to the invention for the ejected drops to be all of the same size. Third, as FIG. 4D illustrates, the invention also allows for operation in a multi-drop mode, as in the Tacklind System. Indeed, according to the invention, the firing rate for the heating element 110 is substantially limited by the collapsing time for the bubbles that form in the low-viscosity ink. For inks with a viscosity in the range of 1–2 centi-Poise, the collapsing time for bubbles large enough to generate an inkjet is typically from about 14 to about 20 microseconds.

This means that the printhead according to the invention can be fired with a rate at or above (indeed, well above) 50 kHz and even at a rate in the range of 70–80 kHz; this also allows the drop velocity to be in the range of 15–20 m/s.

Figure 5A:
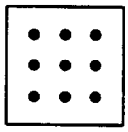
FIGS. 5A–5D illustrate the way in which the inkjet printer according to the invention creates pixels with different optical densities.

FIGS. 5A–5D illustrate the way in which the printhead according to the invention creates pixels with different optical densities. In FIG. 5A, the printhead according to the invention has been operated well below its potential firing rate, that is, with a conventional firing rate that allows the meniscus to settle after one drop has been fired and before a subsequent drop is fired. As is discussed above, this rate may be as low as 10 kHz or lower, but can in general be determined using conventional calibration methods for any given ink viscosity. As Figure SA shows, the printhead according to the invention can place drops as accurately as conventional printheads simply by lowering the firing rate enough to allow the meniscus of the ink to settle between firings.

Figure 5B:
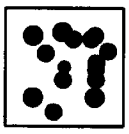
Figure 5C:
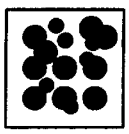
Figure 5D:
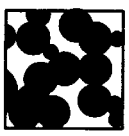

In FIG. 5B, the printhead according to the invention has been operated with the fast firing rate that produces the sequence illustrated in FIGS. 4A–4F. Note that the average optical density of the pixel depicted in FIG. 5B is at least roughly the same as that of the pixel depicted in FIG. 5A, but that it will have been produced much faster. FIGS. 5C and 5D illustrate pixels with increasing optical densities that are roughly the same as the optical densities of the pixels illustrated in FIGS. 3C and 3D, respectively. Once again, although the optical densities can be the same, the invention creates the pixels much faster, since it does not need the meniscus to become planar before firing the next drop.

By comparing FIGS. 5A and 5B one can see that a slow firing rate with highly accurate drop placement (FIG. 5A) in general produces more uniform drop patterns with sharper edges than does the high-speed firing method according to the invention, even though the average optical densities may be the same. Such sharp edges are usually preferable for printing text, since non-uniform boundaries for ink patterns within text pixels make the letters of the text look "fuzzy." Consequently, the trend of most manufacturers of thermal inkjet printers is to attempt to fit more well-placed drops or "dots" in each unit area; this is normally expressed in terms of "dots per inch," or "dpi". Most of the highest quality conventional thermal inkjet printers now sold operate at between 300 dpi and 600 dpi for both text and non-text images. On the other hand, the well-defined drop pattern best suited for text will often make non-text images look "grainier" than necessary, since a viewer, at close distances, can often easily distinguish the individual dots (pixels) that make up the non-text image. The "random," non-uniform pattern of drops that the invention produces (see FIG. 5B) is not as "crisp" as the pattern in FIG. 5A, but the non-uniformity of the pattern will normally give non-text image (as opposed to text) pixels a much "smoother" appearance; indeed, the boundary between adjacent pixels will often not even be distinguishable. As a result, prototype non-text images produced using the high-speed firing method of the invention at 300 dots-per-inch (dpi) were noticeably more life-like than the same images produced using conventional low-rate printing at 300 dpi.

According to an alternative, dual-mode operating method of the invention, the invented printer may be switched between a text-mode and a non-text image mode. In the text-mode, the printhead is fired at a low rate, that is, at the firing rates of conventional printheads, to place drops accurately with a uniform pattern (FIG. 5A). The resolution of the printer can thereby be increased to that typical for high-quality text printing, which at present is roughly 600 dpi. If a printhead for 600 dpi is used, resolution can be decreased to 300 dpi for the non-text image mode in any known manner. Standard calibration methods (to determine optical densities as a function of activation periods) may be used for both the text and non-text image modes.

The image mode is described above: the firing rate is increased to near the limit allowed by the cycle time of the heating element and the collapse rate of the bubbles. As is described above, for known inks, this will be above 50 kHz and even above 70 kHz. The firing rate of the printhead may be controlled by known hardware or software.

According to the invention, switching between the non-text image and text-modes can be done either manually or automatically. Manual switching can involve physically pressing a button, turning a selector, or using some other actuator that indicates to the printer or controlling processor which mode is to be used, or it can be done by entering a suitable command or parameter into the software with any standard input device such as a keyboard or mouse.

Automatic switching can be accomplished in conjunction with known text-recognition software. Such software (found, for example, in document scanners) analyzes the bit or pixel pattern of a field and determines whether the field contains recognizable text features such as letters, punctuation marks, underlining, italics, and so on. This known software typically also determines the boundaries of text fields on a page.

Since such software normally operates on a bitmapped, digitized (scanned), stored representation of the page, as opposed to on the page directly, it can just as well operate on a bit-mapped representation, stored in memory, of an image to be printed. When the printhead of the thermal inkjet printer is printing in a field of text, the software can set the printhead into the text-mode, in which the firing rate is reduced to a conventional rate that allows the meniscus to settle after each drop is fired (see FIG. 5A). Over fields that the software interprets as non-text, however, the printhead can be switched into the spray-mode as described above, in which drops are fired faster than the time required for the meniscus to settle. This dual-mode operation will speed up printing of non-text images (and also soften the contours of the pixels) while still allowing sharp printing of text.

Figure 6:
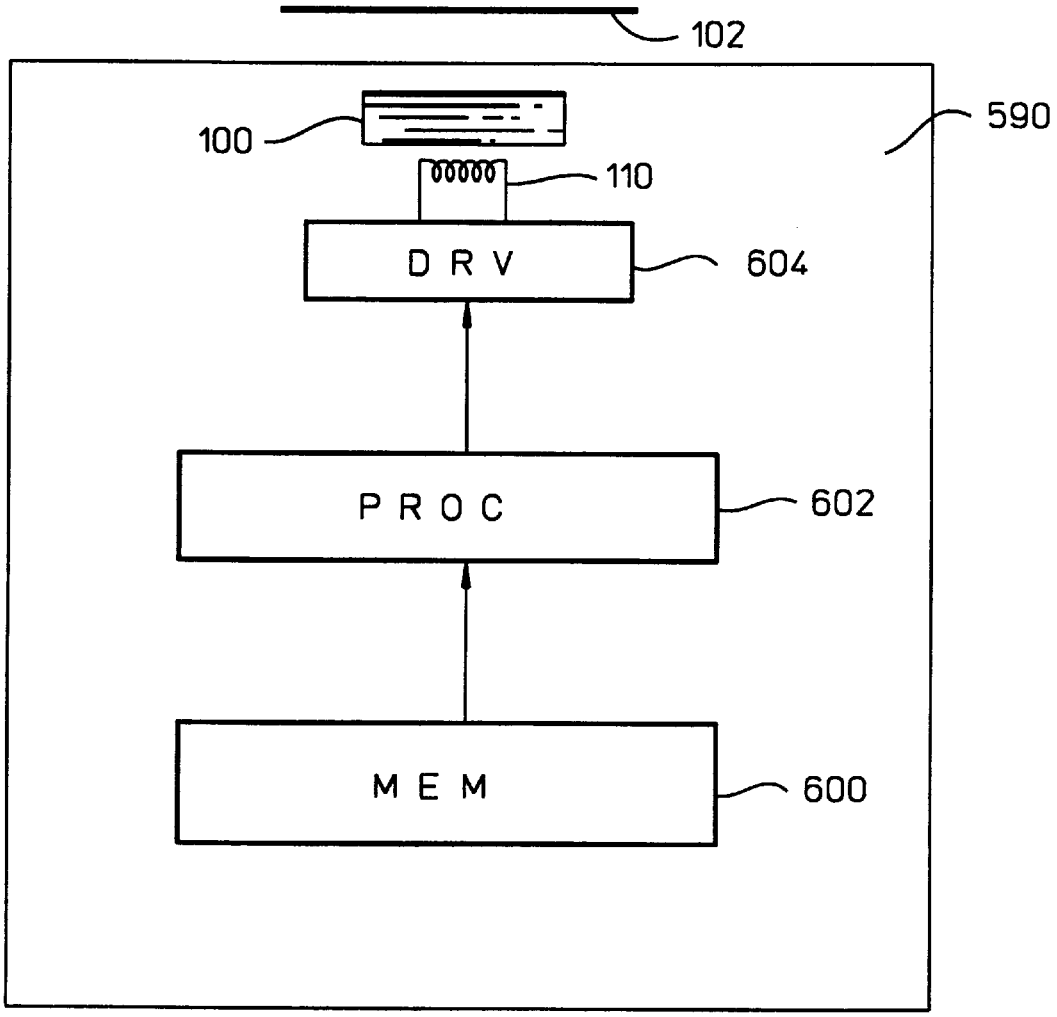
FIG. 6 is a block diagram of some of the logical electrical components of a thermal inkjet printer.

FIG. 6 is a block diagram of logical electrical components of a thermal inkjet printer 590. Some digital representations of the image to be printed on the printing surface 102 are stored as data in a memory 600. A control circuit 602 fetches printing parameters such as the firing rate, either from the memory 600, from some other conventional device, or from internal settings or calculations. Other parameters fetched are the non-text image and text data. Based on the parameters fetched, the control circuit sent control signals to a drive circuit 604, which pulses the heating element 110. Such data storage, control, and drive circuitry are well known for thermal inkjet printers. However, in the invented printer, the drive circuit 604 can operate the printhead 100 in both the spray-mode to print non-text images, and in the text-mode to print text. Also, only one printhead is shown in the figures. In an actual printer, typically, there can be many more printheads, and the present invention is applicable to each of them.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

We claim:

1. A method for printing using an inkjet printer, which includes ink, a heating element and a drive circuit that sends power to the heating element to heat the ink and to eject droplets of ink toward a printing surface, the method comprising the following steps:

sending power, by the drive circuit, in pulses, at a firing rate, to the heating element to heat the ink, with each pulse ejecting a droplet of ink toward the printing surface;

wherein the drive circuit sends pulses to the heating element in a spray-mode, the spray-mode being characterized by the drive circuit sending pulses to the heating element so that, based on the firing rate of the pulses applied to the heating element, a plurality of droplets can be ejected from the heating element in directions that are not perpendicular to the printing surface to produce a random pattern of droplets on the printing surface.

2. A method as defined in claim 1, wherein the firing rate is at least 50 kHz.

3. A method as defined in claim 2, wherein the firing rate is at least 70 kHz.

4. A method as defined in claim 1, wherein the ink has a viscosity of less than 10 centi-Poise.

5. A method as defined in claim 4, wherein the ink has a viscosity of less than 2 centi-Poise.

6. A method for printing using an inkjet printer, which includes ink, a heating element and a drive circuit that sends power to the heating element to heat the ink and to elect droplets of ink toward a printing surface, the method comprising the following steps:

dividing a digital representation of an image to be printed into non-text image fields and text fields;

sending power, by the drive circuit, in pulses, at a firing rate, to the heating element to heat the ink, with each pulse ejecting a droplet of ink toward the printing surface;

printing each non-text image field on the printing surface in a spray-mode, the spray-mode being characterized by the drive circuit sending pulses to the heating element so that based on the firing rate of the pulses applied to the heating element, a plurality of droplets can be ejected from the heating element in directions that are not perpendicular to the printing surface to produce a random pattern of droplets on the printing surface; and printing each text field on the printing surface in text-mode, in which the corresponding ink droplets are projected onto the printing surface in a direction that is substantially perpendicular to the printing surface.

7. A method as defined in claim 6, wherein the firing rate is at least 50 kHz for the spray-mode.

8. A method as defined in claim 7, wherein the firing rate is at least 70 kHz for the spray-mode.

9. A method as defined in claim 6, wherein the ink has a viscosity of less than 10 centi-Poise.

10. A method as defined in claim 9, wherein the ink has a viscosity of less than 2 centi-Poise.

11. A thermal inkjet printer comprising:

ink;

a heating element thermally coupled to the ink;

a drive circuit sending power in pulses, at a firing rate, to the heating element to heat the ink, with each pulse ejecting a droplet of ink toward a printing surface;

wherein the drive circuit sends pulses to the heating element in a spray-mode, the spray-mode being characterized by the drive circuit sending pulses to the heating element so that, based on the firing rate of the pulses applied to the heating element, a plurality of droplets can be ejected from the heating element in directions that are not perpendicular to the printing surface to produce a random pattern of droplets on the printing surface.

12. A thermal inkjet printer as defined in claim 11, wherein the firing rate is at least 50 kHz.

13. A thermal inkjet printer as defined in claim 12, wherein the firing rate is at least 70 kHz.

14. A thermal inkjet printer as defined in claim 11, wherein the ink has a viscosity of less than 10 centi-Poise.

15. A thermal inkjet printer as defined in claim 14, wherein the ink has a viscosity of less than 2 centi-Poise.

16. A thermal inkjet printer comprising:

ink;

a heating element thermally coupled to the ink;

a drive circuit sending power in pulses, at a firing rate, to the heating element to heat the ink, with each pulse ejecting a droplet of ink toward a printing surface;

wherein the drive circuit sends pulses to the heating element in a text-mode so that the corresponding ink droplets are projected onto the printing surface in a direction that is substantially perpendicular to the printing surface, and the drive circuit sends pulses to the heating element in a spray-mode, the spray-mode being characterized by the drive circuit sending pulses to the heating element so that, based on the firing rate of the pulses applied to the heating element, a plurality of droplets can be ejected from the heating element in directions that are not perpendicular to the printing surface to produce a random pattern of droplets on the printing surface.

17. A thermal inkjet printer as defined in claim 16, wherein the firing rate is at least 50 kHz for the spray-mode.

18. A thermal inkjet printer as defined in claim 17, wherein the firing rate is at least 70 kHz for the spray-mode.

19. A thermal inkjet printer as defined in claim 16, wherein the ink has a viscosity of less than 10 centi-Poise.

20. A thermal inkjet printer as defined in claim 19, wherein the ink has a viscosity of less than 2 centi-Poise.

* * * * *